United States Patent [19]

Willmott et al.

[11] Patent Number: 4,794,731

[45] Date of Patent: Jan. 3, 1989

[54] TWIN SPROCKET GARAGE DOOR OPENER

[75] Inventors: Colin B. Willmott, Buffalo Grove; James S. Chang, Arlington Heights, both of Ill.

[73] Assignee: The Chamberlain Group, Inc., Elmhurst, Ill.

[21] Appl. No.: 61,975

[22] Filed: Jun. 15, 1987

[51] Int. Cl.[4] ..... E05F 15/00

[52] U.S. Cl. ..... 49/199; 49/360; 474/140; 474/160

[58] Field of Search ..... 49/197, 199, 324, 360; 474/158, 159, 160, 140, 151, 78

[56] References Cited

U.S. PATENT DOCUMENTS 531,220 12/1894 Robinson ..... 474/77

4,231,191 11/1980 Ellmore ..... 49/360

*Primary Examiner*—Kenneth J. Dorner

*Assistant Examiner*—Gerald A. Anderson

*Attorney, Agent, or Firm*—Hill, Van Santen, Steadman & Simpson

[57] ABSTRACT

An adjustable speed garage door operator which has a longitudinal rail with a trolley mounted on the rail and connected to a door to open and close it. A chain is connected to the trolley and is mounted on a front idler sprocket and can be selectively mounted on different drive sprockets which have different numbers of teeth so as to vary the speed of the door.

2 Claims, 2 Drawing Sheets

FIG.2
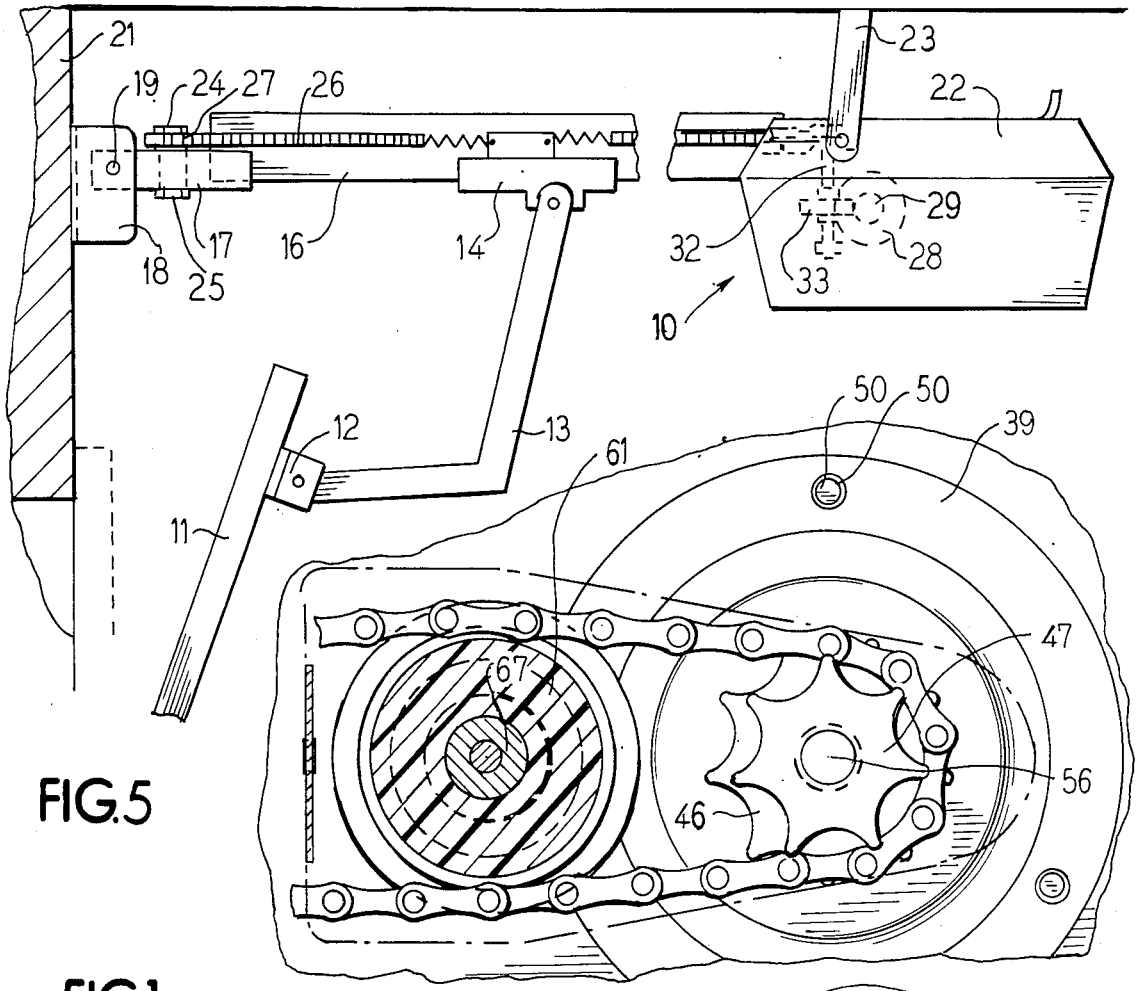
FIG.5
FIG.1
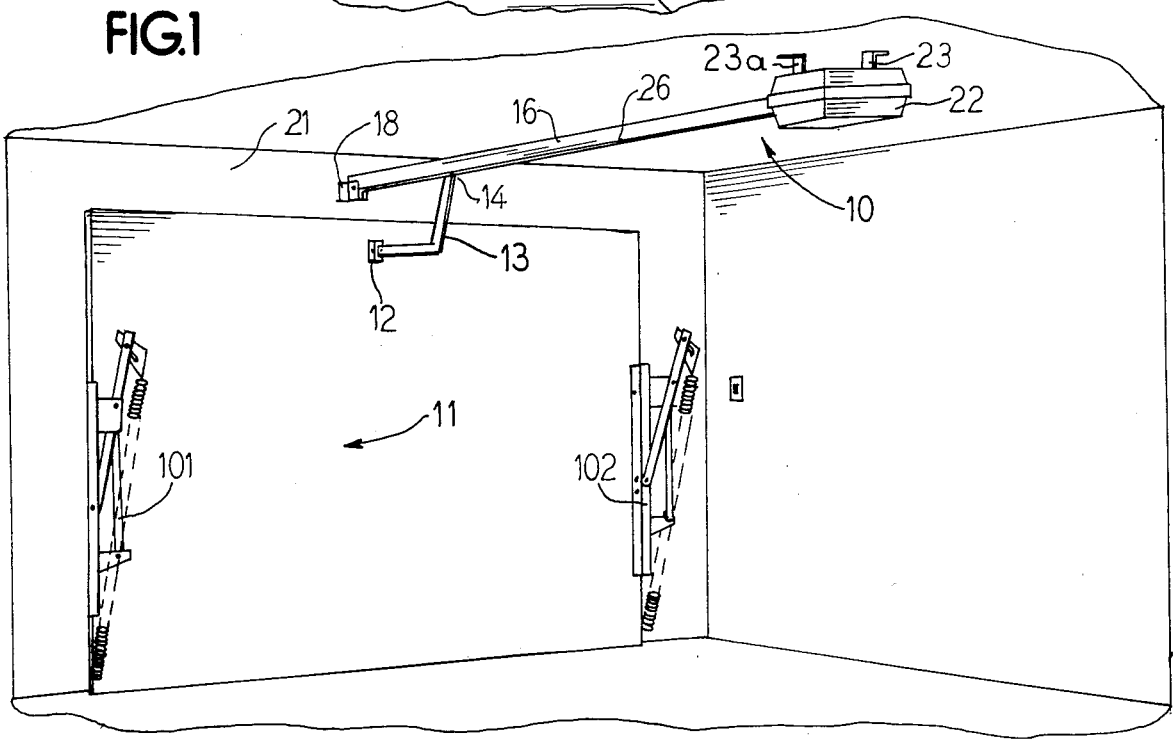

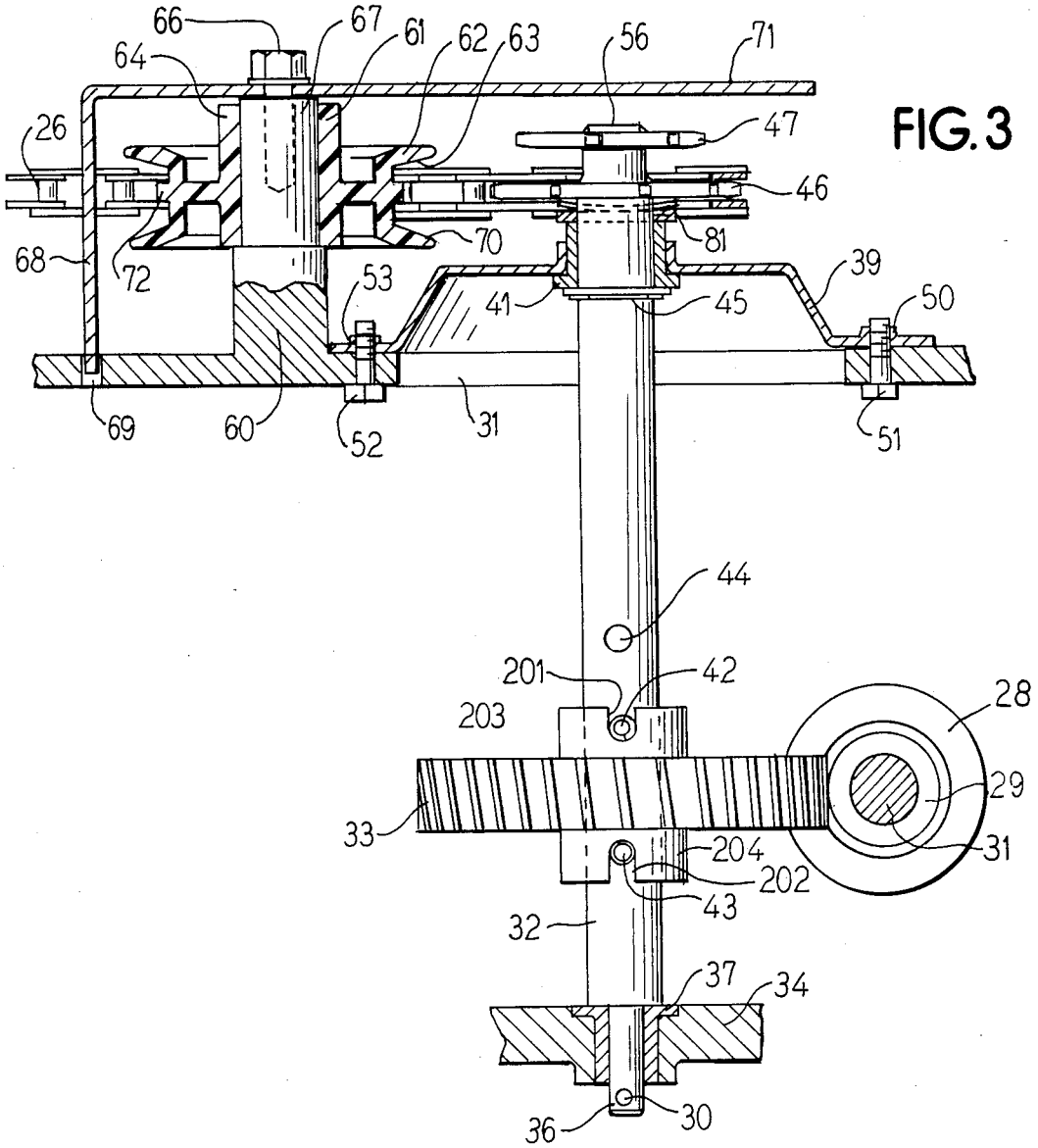
FIG. 3
FIG. 4
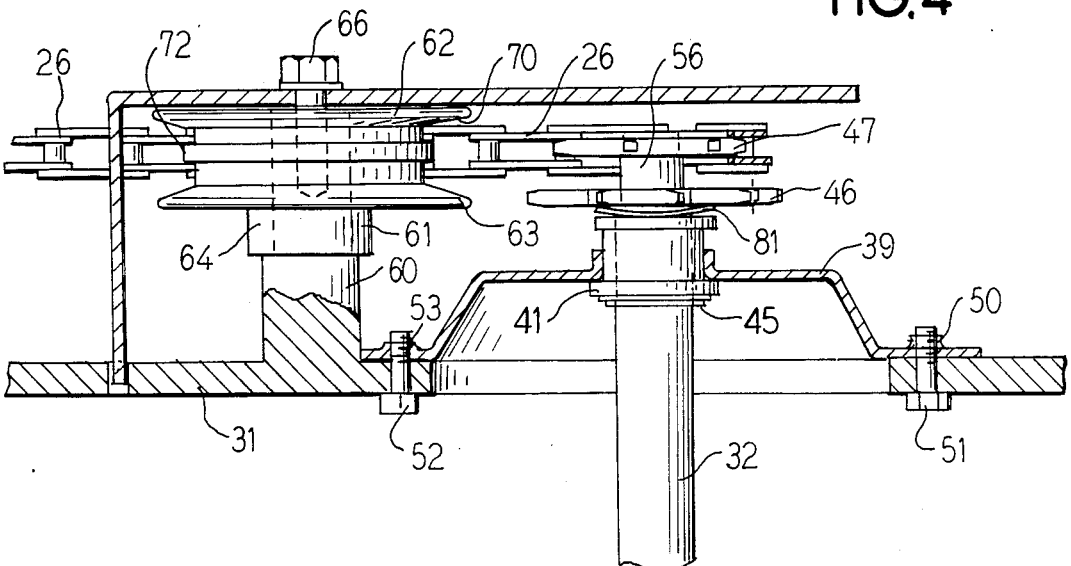

TWIN SPROCKET GARAGE DOOR OPENER

BACKGROUND OF THE INVENTION

1. Field of the Invention

This invention relates in general to a garage door operator and in particular to a novel garage door operator that can be operated at two different speeds.

2. Description of the Prior Art

Prior art garage door operators are driven by a motor which runs at a substantially constant speed and, thus, prior art garage door operators have operated at fixed speeds for closing and opening. U.S. Pat. No. 4,274,227 which issued on June 23, 1981 assigned to the assignee of the present application and U.S. Pat. No. 4,037,201 assigned to the assignee of the present application disclose garage door operators and such disclosures are incorporated by reference into the present application.

SUMMARY OF THE INVENTION

The present invention relates to a garage door operator wherein the output shaft of the motor is provided with a plurality of sprockets having different numbers of teeth which are driven by the motor such that the driving chain of the garage door operator can be selectively mounted on one of the pluralities of sprockets such that the speed of the chain can be varied to thus select a desire speed for operation of the garage door operator. An idler pulley is provided adjacent the plurality of sprockets and is formed with a hub such that when the pulley is mounted in a first orientation it guides the chain relative to a first sprocket and when it is mounted in a second orientation, it guides the chain relative to a second sprocket.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

BRIEF DESCRIPTION OF THE DRAWINGS

FIG. 1 is a perspective view illustrating a garage door operator a door;

FIG. 2 is a side plan view of the garage door operator;

FIG. 3 is a side plan view of the multiple sprockets and idler pulley;

FIG. 4 is a chain on a different socket than in FIG. 3; and

FIG. 5 is a top plan view of the plurality of sprockets and idler pulley.

DESCRIPTION OF THE PREFERRED EMBODIMENTS

FIG. 1 illustrates a one-piece garage door 11 which is actuated by garage door operator 10. The one-piece door 11 is supported by suitable pivoting and spring biasing kicker means 101 and 102 from opposite sides of the door frame. One end of the rail 16 of the garage door operator is connected by a bracket 18 to the header 21 above the door and the other end including the motor and driving components are connected to the rail 16 and are mounted in a housing 22 which is connected to the ceiling of the garage by frame members 23 and 23*a*. The operator drives a chain 26 which moves a trolley 14 which carries an L-shape pivotally supported arm 13 which is connected to a bracket 12 of the door 11.

FIG. 2 illustrates the chain 26 which passes over a sprocket 24 rotatably supported near the bracket 18 with a suitable pin 25 which passes through an extension 17 that extends from the rail 16 to the bracket 18 and a pin 19 passes through the member 17 and connects it to the bracket 18. As shown in FIGS. 3, 4 and 5, a motor 28 is mounted in the housing 22 and has a worm 29 mounted on its output shaft 31. The worm 29 meshes with a worm gear 33 non-rotatably mounted on a shaft 32 which has a small end 36 which is received in a bearing 37 mounted in frame member 34 as shown in FIG. 3. A pin 30 extends through the end 36 of the shaft 32 to lock it in the bearing 37. Pins 42 and 43 pass through the shaft 32 and extend through slots 201 and 202 formed in collars 203 and 204 of the gear 33 so that the gear is non-rotatably mounted on the shaft 32. An opening 44 is formed through the shaft 32 so as to allow the gear 33 to be mounted on the shaft 32 at a different vertical position relative to FIG. 3.

The upper end relative to FIG. 3 of shaft 32 is rotatably supported by an upper frame member 31 which has an aligned opening through which the shaft extends and a cup-shape bearing member 39 has an outer flange in which threaded openings 50 and 53 are formed and in a particular embodiment three equally spaced openings were formed in the flange of the support member 39. The bearing member 39 is attached to the frame 31 by suitable bolts such as 51 and 52 shown in FIGS. 3 and 4, for example. A bearing 41 is attached to the support 39 and a washer 45 is connected to the shaft 32 adjacent the bearing 41. A first sprocket 46 is mounted on the shaft 32 above the bearing 47 and is welded or is otherwise suitably connected to the shaft 32 so it cannot rotate relative thereto. A second sprocket 47 having a different number of teeth than sprocket 46 is non-rotatably connected to the shaft 32 above the sprocket 46 as shown in FIG. 3, for example. The sprockets 47 and 46 may be welded or braised to the shaft 32, for example. The upper end 56 of the shaft 32 is reduced in cross-section as illustrated.

A bearing washer 81 is connected to the shaft 32 and rotates therewith and engages the upper end of the bearing 41. The frame member 31 has a shaft 60 which extends upwardly therefrom upon which is rotatably mounted an idler pulley 61. The idler pulley 61 is formed with a hub 64 on one side thereof. The pulley portion 62 has side flanges 63 and 70 in which the chain 26 is received and a circular extension 72 is mounted in the groove between the portion 63 and 70 so as to guide the chain on the sprocket. A bolt 66 is threadedly received in the decreased diameter shaft portion 67 of the shaft 60 so as to lock the pulley on the shaft portion 67 such that it is free to rotate with the chain 26.

In operation, if it is desired to mount the chain 26 on the larger sprocket 46 which in a particular example had nine teeth, the idler pulley 61 is mounted as shown in FIG. 3 such that the groove of the pulley between the portions 62 and 63 aligns with the sprocket 46 and the chain 26 is mounted over the sprocket 46 and fits in the groove of idler pulley 61 as shown in FIG. 3. An L-shaped cover plate 68 has one end receivable in an opening 69 of the frame member 31 and has a horizontal 71 which extends horizontally over the sprockets and 47, 46 and the pulley 61 to form a guard. Thus, with the chain engaged with the sprocket 46 which has nine teeth as shown in FIG. 3, it will drive the door 11 upwardly and downwardly faster than when it is engaged with the sprocket 47 which has a smaller number of teeth as, for example, in a particular example 7 teeth.

When it is desired to drive the garage slower, the idler pulley 61 is inverted to the position shown in FIG. 4 by removing the cover plate 68 and the bolt 66 which is threadedly received in the smaller portion 67 of the shaft 60 and the pulley is turned over so that the hub 64 bears against the larger diameter portion of the shaft 60 as shown in FIG. 4 and then the bolt 66 is again replaced to attach the pulley 61 to the shaft portion 67 but with an orientation so that if the pulley aligns the chain 26 with the sprocket 47 upon which it is mounted.

FIG. 5 is a top view of the sprockets 46 and 47 and the idler pulley 61 and illustrates the chain mounted on the larger sprocket 46 and the idler pulley mounted on the shaft 67 in the orientation illustrated in FIG. 3.

It is seen that the present invention allows the motor of a garage door operator to be coupled to a chain through either a larger or smaller sprocket such that the speed of the garage door operator can be varied. Although the invention has been described with respect to preferred embodiments, it is not to be so limited as changes and modifications may be made therein which are within the full intended scope of the invention as defined by the appended claims.

We claim as our invention:

1. An adjustable speed garage door operator for a garage door comprising, a frame member, a motor mounted on said frame member, an output shaft coupled to said motor and rotatably mounted on said frame member, a plurality of sprockets with different number of teeth mounted on said output shaft, a longitudinal rail member with one end attached to said frame member, a trolley movably mounted on said rail and connected to said garage door, an endless chain, a front sprocket rotatably mounted to said rail and said chain mounted thereon, and said chain selectively mountable on one of said plurality of sprockets so as to select a particular operating speed for said garage door operator, including an idler pulley rotatably and adjustably mounted to said frame member adjacent to said plurality of sprockets and said chain engageable with said idler pulley so as to guide said chain over a selected one of said plurality of sprockets, and wherein said idler pulley is mounted on a vertical pulley shaft which is connected to said frame member and said idler pulley is formed with a collar on one side such that by inverting it on said pulley shaft the height of said idler pulley can be adjusted so as to align it with different ones of said plurality of sprockets.

2. An adjustable speed garage door operator according to claim 1, wherein said idler pulley is formed with an annular guide extension which engages said chain to hold it on said idler pulley.

* * * * *